United States Patent [19]

Masika

[11] 4,085,519

[45] Apr. 25, 1978

[54] DRYING DEVICE

[76] Inventor: Nicholas Masika, 7 Desmond Ave., Ottawa, Ontario, Canada, K2B 7W6

[21] Appl. No.: 715,618

[22] Filed: Aug. 18, 1976

[30] Foreign Application Priority Data

May 7, 1976 Canada ..... 252009

[51] Int. Cl.[2] ..... F26B 25/00

[52] U.S. Cl. ..... 34/104

[58] Field of Search ..... 34/104, 201, 151, 233, 34/243 R, 90

[56] References Cited

U.S. PATENT DOCUMENTS

| | | | |
|---|---|---|---|
| 386,746 | 7/1888 | Hess | 34/104 |
| 426,111 | 4/1890 | Coffin | 34/104 |
| 629,944 | 8/1899 | Witmer | 34/104 |
| 1,450,033 | 3/1923 | Gowan | 34/104 |
| 1,590,143 | 6/1926 | Williams | 34/151 |
| 2,239,572 | 4/1941 | Richa | 34/104 |
| 2,614,337 | 10/1952 | Darbo | 34/104 |
| 3,645,009 | 2/1972 | Ketchum | 34/104 |

FOREIGN PATENT DOCUMENTS

| | | | |
|---|---|---|---|
| 1,320,076 | 1/1963 | France | 34/104 |

*Primary Examiner*—Kenneth W. Sprague
*Assistant Examiner*—James C. Yeung

[57] ABSTRACT

A device is described for drying boots, shoes, gloves, etc. in association with a household forced hot air furnace. The device includes a cover plate for fitting over and completely enclosing a standard warm air outlet of a forced hot air furnace, this cover plate having at least one opening, and at least one nozzle member detachably connectable to the at least one cover plate opening, the nozzle being adapted to direct air forced from the outlet by the furnace onto and/or into articles to be dried.

3 Claims, 8 Drawing Figures

DRYING DEVICE

This invention relates to a drying device for use in association with a household forced hot air furnace, useful for drying boots, shoes, gloves, etc.

During the winter season one of the perennial problems in any household, and particularly one with children, is that of nightly drying damp boots, gloves, etc. The common practice in households with a forced hot air furnace is to place the gloves and boots on top of a warm air outlet. Of course, the problem in this is drying of the inner parts of both the boots and gloves. Thus, the boots are stood upside down on the register or maybe placed on a length of stick, etc. in an effort to direct the warm air into the interior of the boot so as to dry the lining.

Various early devices were proposed for drying boots such as the structure shown in Canadian Pat. No. 266,465 and more a complicated system including an electric heater and blower has been more recently devloped, such as described in Canadian Pat. No. 753,404. Of course, the electric heater and blower combination becomes rather expensive and it seemed to the applicant that it should be possible to develope some kind of very simply and inexpensive arrangement which could effectively dry boots and the like while making efficient use of the warm air emerging from a forced air furnace.

The article drying device of the present invention is adapted for use in association with a household forced air furnace and comprises a cover plate for fitting over and completely enclosing an air outlet of the forced hot air furnace. This cover plate has at least one opening and at least one nozzle member is detachably connectable to this opening, the nozzle being adapted to direct air forced from the outlet by the furnace onto and/or into articles to be dried.

The cover plate is preferably a flat rectangular plate with a rectangular flange extending downward from the bottom face of the plate. This flange is adapted to extend into a rectangular furnace outlet in close proximity to the outlet edges. In this manner the cover plate completely encloses the air outlet. The cover plate is also preferably provided with a pair of spaced circular holes capable of receiving the nozzle members.

One particularly preferred form of the nozzle member is an elongated tubular member, one end thereof snuggly engageable with a cover plate hole and the other end emerging into an angularly extending tubular nozzle portion. Such a nozzle is particularly suitable for the drying of high boots.

Another preferred form of nozzle member is a Y-shaped member having a central tubular portion snuggly engagable at one end with a cover plate hole and the other end emerging into a pair of branch tubular sections. This nozzle member is particularly well suited for the drying of low boots, skates or gloves.

The nozzle portion may also be in the form of a long flexible tube with a connector at one end for connecting to the cover plate opening and a nozzle portion at the other end. This can be used for a variety of household drying needs. When using the flexible nozzle, it is preferable to provide a cap over the second cover plate opening so that a maximum amount of warm air is forced through the nozzle.

Both the cover plate and rigid nozzles can be manufactured from sheet metal or molded from heat resistant plastics or other man-made material. The great advantages of the device according to the invention are that it is assembled and taken apart very readily and is sufficiently compact to be stored on a shelf or in a drawer. Moreover, it is even possible to leave the cover plate in position with the openings uncovered for normal room heating and then merely mount the nozzles when it is desired to dry some articles.

Certain preferred embodiments of the invention are further illustrated by the attached drawings in which.

Figure 8:
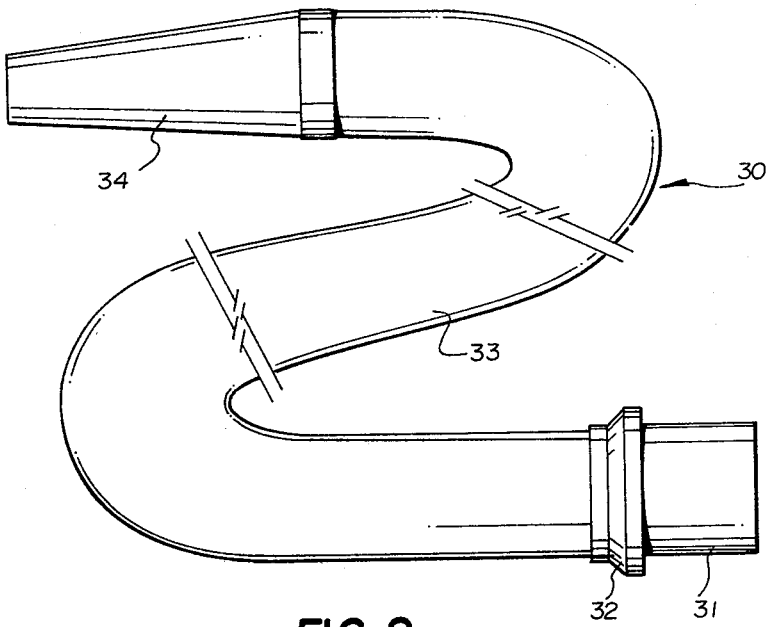
Figure 6:
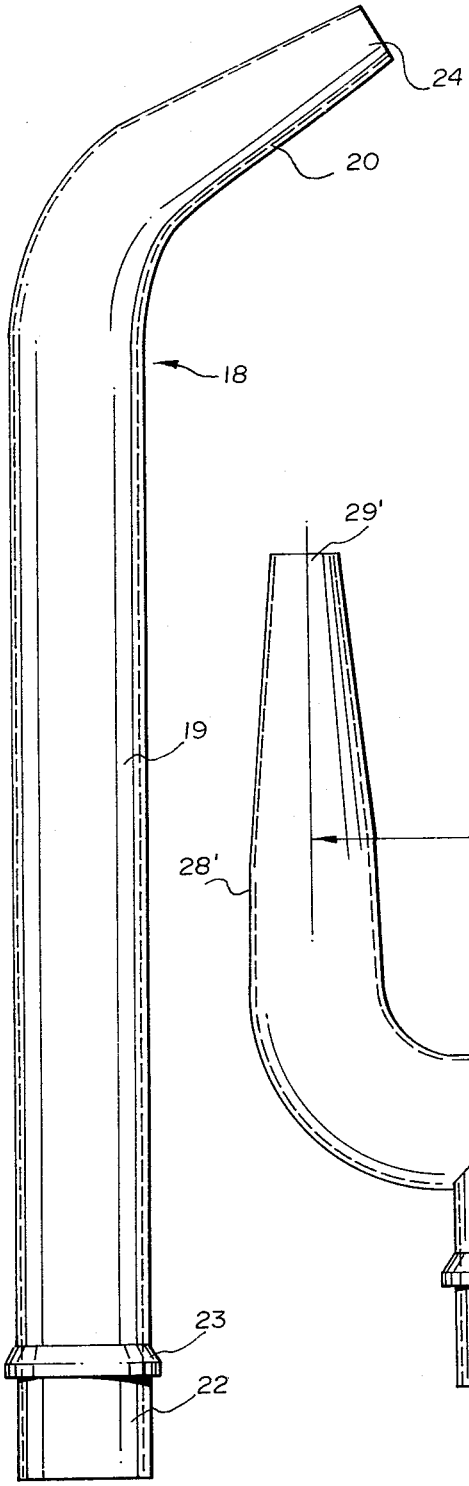
FIG. 6 is an elevation of a long nozzle.

FIG. 8 is an elevation of a flexible nozzle. The drying device includes a cover plate 10 which is designed to fit within normal household forced hot air furnace outlet openings. This base plate includes a flat panel 11 of heat resistant rigid sheet material and extending from the lower face of this plate 11 is a rectangular flange 12 which is designed to fit within a warm air outlet. A shallow flange 13 may also project upwardly from the upper face of plate 11.

Within plate 11 are openings 14 and 15 formed by short tubular sections 16 and 17 fixed within openings in plate 11. The tubular sections 16 and 17 have a length sufficient to hold the nozzles securely in place.

Figure 1:
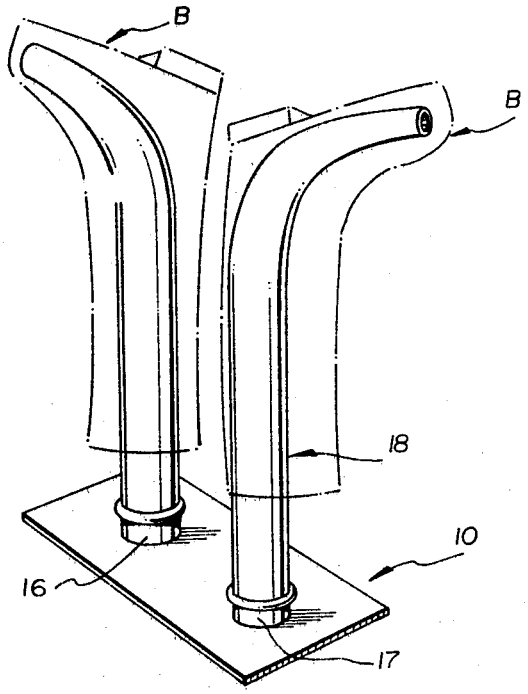
FIG. 1 is a perspective view of one embodiment of the invention.

As shown in FIG. 1, a pair of tall nozzles 18 can be mounted within the tubular sections 16 and 17. Each nozzle member 18 includes a long tubular section 19 merging into an annular tapering outlet section 20. The lower end of tubular section 19 includes an outer abutment ring 23 which rests on tubular section 16 or 17 with the bottom tubular portion 22 of nozzle 18 fitting snuggly within tubular section 16 or 17.

With a pair of these long nozzles in position as shown in FIG. 1, articles such as ladies' tall boots (B) can be placed over the nozzles so that warm is directed into the inner portions of the boots where the drying effect is most needed. Under normal winter conditions with this arrangement a pair of high winter boots will be completely dried within about an hour under normal furnace operation.

Figure 2:
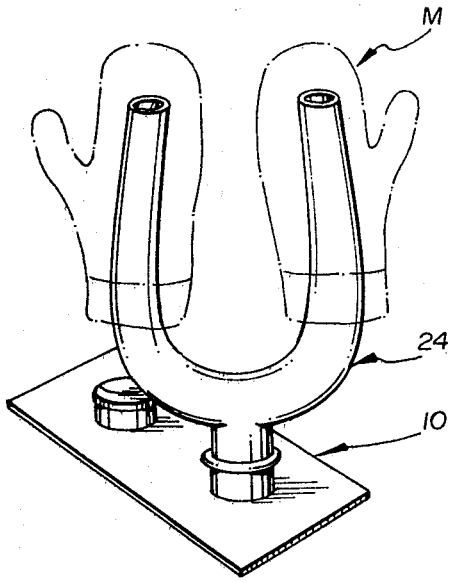
FIG. 2 is a perspective view of a second embodiment of the invention.
Figure 3:
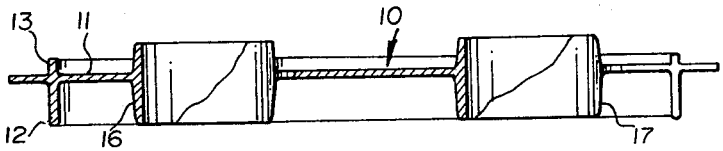
FIG. 3 is a elevation in section of a cover plate.
Figure 4:
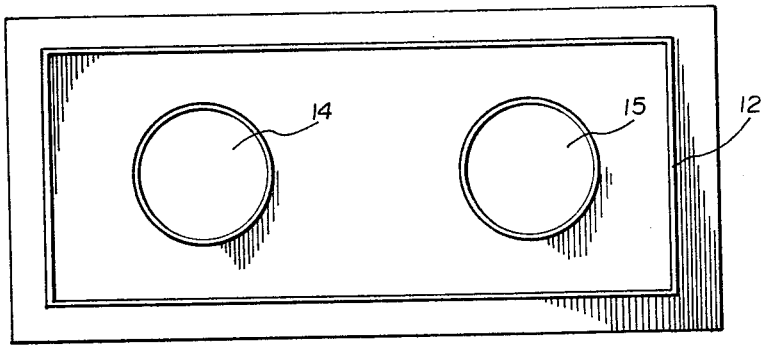
FIG. 4 is a plan view of the cover plate.

FIG. 2 shows another form of nozzle arrangement with a Y-configuration providing two short nozzles from one cover plate opening. The Y-shaped nozzle 24 includes a main tubular stem portion 25 with an abutment ring 27 which rests on opening sleeve 16 or 17 with the tubular extension 26 fitting snuggly within the opening sleeve. The upper end of tubular stem 25 divides into two upwardly extending short nozzle portions 28 and 28' having air outlets 29 and 29'. Two of these nozzles can be mounted in the cover plate openings or one of the openings can be closed by a closure cap so as to direct all of the warm air coming through the furnace outlet through the one nozzle arrangement 24. Of course, it may also be desirable to simply leave one of the openings uncovered to allow some heat to pass directly into the room while at the same time more slowly drying articles resting on the nozzles.

The short Y-shaped nozzle arrangement is particularly useful for smaller objects such as gloves, mitts, children'sboots, skates, etc.

Figure 5:
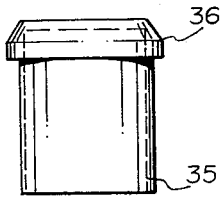
FIG. 5 is an elevation of a closure cap for a cover plate opening.
Figure 7:
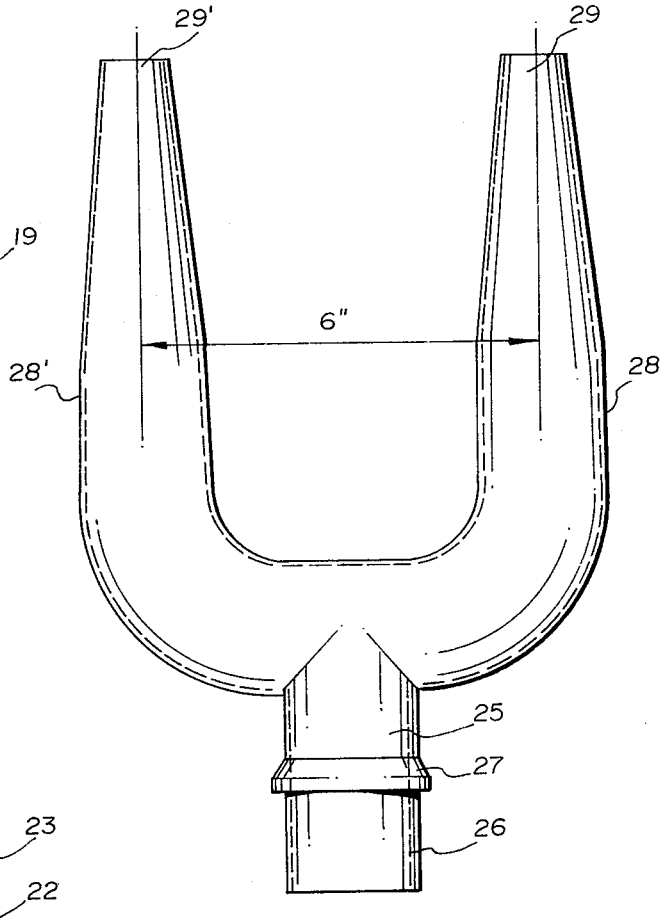
FIG. 7 is an elevation of a Y-shaped nozzle.

Most any kind of closure cap can be used for one of the openings when this required. However, a convenient form is that shown in FIG. 5 with a tubular portion 35 and an enlarged cap portion 36 which rests directly on top of opening sleeve 16 or 17.

For yet other drying purposes the nozzle can be in flexible form as shown in FIG. 8. This nozzle 30 includes a rigid stem portion 31 and an abutment ring 32 so that the stem 31 fits snuggly within opening sleeve 16 or 17 with the abutment ring 32 resting on top of the sleeve. The stem and ring connect to a flexible tube 33 having mounted on the other end thereof a nozzle 34. In order for this flexible nozzle to be effective for drying, it is usually desirable to use only a single nozzle with the second opening being closed by a closure cap.

The embodiments of the invention in which an exclusive property or privilege is claimed are defined as follows:

1. An ariticle drying device adapted for use in association with a household forced hot air furnace, said device comprising a cover plate for fitting over and completely enclosing an air outlet of a forced hot air furnace, said cover plate being in the form of a flat rectangular plate with a rectangular flange extending downwardly from the bottom face thereof, said flange being adapted to extend into a rectangular furnace outlet in close proximity to the edges thereof, at least one circular hole in said cover plate with a tubular sleeve fixed therein and a nozzle member mountable in said tubular sleeve, said nozzle member being an elongated tublar member, one end thereof including a cylindrical tubular portion snugly engagable with said tubular sleeve and the other end merging into an angularly extending tubular nozzle portion, said cylindrical tubular portion including a peripheral abutment ring for engaging the top of the tubular sleeve.

2. An article drying device adapted for use in association with a household forced hot air furnace, said device comprising a cover plate for fitting over and completely enclosing an air outlet of a forced hot air furnace, said cover plate being in the form of a flat rectangular plate with a rectangular flange extending downwardly from the bottom face thereof, said flange being adapted to extend into a rectangular furnace outlet in close proximity to the edges thereof, at least one circular hole in said cover plate with a tubular sleeve fixed therein and a nozzle member mountable in said tubular sleeve, said nozzle member being a Y-shaped member having a central tubular member, one end thereof including a cylindrical tubular portion snugly engagable with said tubular sleeve and the other end merging into a pair of branched tubular nozzle portions, said cylindrical tubular portion including a peripheral abutment ring for engaging the top of the tubular sleeve.

3. An article drying device adapted for use in association with a household forced hot air furnace, said device comprising a cover plate for fitting over and completely enclosing an air outlet of a forced hot air furnace, said cover plate being in the form of a flat rectangular plate with a rectangular flange extending downwardly from the bottom face thereof, said flange being adapted to extend into a rectangular furnace outlet in close proximity to the edges thereof, at least one circular hole in said cover plate with a tubular sleeve fixed therein and a nozzle member mountable in said tubular sleeve, said nozzle member being an elongated flexible tubular member, one end thereof having a cylindrical tubular portion snugly engagable with said tubular sleeve and the other end terminating in a nozzle portion, said cylindrical tubular portion including a peripheral abutment ring for engaging the top of the tubular sleeve.

* * * * *